United States Patent [19]

Rath

[11] 4,235,623

[45] Nov. 25, 1980

[54] CONTINUOUS SMELTING METHOD FOR FERROCHROME

[75] Inventor: Gero Rath, Mülheim, Fed. Rep. of Germany

[73] Assignee: DEMAG, Aktiengesellschaft, Duisburg, Fed. Rep. of Germany

[21] Appl. No.: 35,289

[22] Filed: May 2, 1979

Related U.S. Application Data

[63] Continuation of Ser. No. 856,657, Dec. 2, 1977, abandoned.

[30] Foreign Application Priority Data

Dec. 15, 1976 [DE] Fed. Rep. of Germany ..... 2656725

[51] Int. Cl.[3] ..... C22C 39/14

[52] U.S. Cl. ..... 75/11; 75/130.5

[58] Field of Search ..... 75/11, 130.5

[56] References Cited

U.S. PATENT DOCUMENTS

| | | | |
|---|---|---|---|
| 1,715,155 | 5/1929 | Westberg | 75/11 |
| 3,502,461 | 3/1970 | Guttler et al. | 75/11 |
| 3,834,899 | 9/1974 | Tanabe | 75/130.5 |

FOREIGN PATENT DOCUMENTS 613591 11/1948 United Kingdom .

*Primary Examiner*—M. J. Andrews

*Attorney, Agent, or Firm*—Mandeville and Schweitzer

[57] ABSTRACT

A method is provided for continuous smelting of ferrochrome with less than 6.5% by weight carbon content in an electric reduction furnace. In the described method, separately from the normal mixture of ores continuously fed into the melt, and consisting of lumpy ore agglomerated fine ore, part of the mixture of ores is introduced as wholly or partially unreduced oxide-rich chrome ore directly into the bath of slag. The introduction of the oxide-rich chrome ore, which is fed separately from the normal mixture of ores, may be made through a hollow electrode into the bath of slag.

3 Claims, No Drawings

CONTINUOUS SMELTING METHOD FOR FERROCHROME

This is a continuation of application Ser. No. 856,657, filed Dec. 2, 1977, now abandoned.

BACKGROUND AND STATEMENT OF THE INVENTION

This invention is concerned with a method of continuous smelting of ferrochrome.

New methods in the steel industry, especially in the smelting of stainless steel, have a considerable influence upon the required chemical composition, and hence upon the technology of smelting ferrochrome. For the smelting of stainless steel the lowest carbon content is sought, if possible below 0.03% by weight, because the final carbon content in the steel has a considerable influence upon the characteristics of stainless steel in use, such as coercive force, resistance to corrosion and weldability.

As long as the smelting of stainless steel was still carried out exclusively in an electric are furnace, or in an induction furnace, low-carbon ferrochrome (refined or overrefined) was added almost exlusively as the alloying material for ferrochrome. But this very low carbon ferrochrome is very expensive in its production and must be smelted in a multi-stage process.

The application of oxygen surface blast converters and bottom blast converters to the production of stainless steel has brought with it a significant alteration in alloy metallurgy, because relatively high-carbon ferrochrome can now be used even for very low carbon steels. By "relatively high-carbon" ferrochrome, we mean ferrochrome with a carbon content of 4 to 6.5% by weight When smelting ferrochrome in an electric reduction furnace, depending upon the reducibility of the chromium burden and the temperature control, carbon contents of 6.5 to 8% by weight are generally obtained. This is based upon the high carbon solubility of the ferrochrome as well as upon the reduction mechanism of the chromium oxide in the largely still solid phase during the sinking of the burden in the furnace.

This high-carbon ferrochrome, in the case of further treatment in the steel industry, requires extended blast times in the converter, whereby the economy of the overall process, and especially the life of the brickwork, becomes severely impaired. It is, therefore, preferred to smelt in an electric reduction furnace ferrochrome with a carbon content of 4 to 6.5%. But this imposes special requirements upon the raw materials used and upon the smelting technique.

Thus, as raw material, ores in lumps, preferably coarsely crystalline, are necessary. It is essential that the ores are chemically resistant to the reduction carbon as long as possible and react largely only in the hot transition zone of the mixture of ores and slag. Through the postponement of the course of the reduction into this hot zone, the reduction is effected very rapidly and the formation of high carbon content chromium carbides, which is also a function of the reaction time, only partially occurs. In this way a greater part of the ore goes into solution as free chromium oxide. This free chromium oxide also partially oxidizes high carbon content chromium carbide which is also very probably still formed. However, for that, higher temperatures are necessary than in the producion of high carbon ferrochrome with 6.5 to 8% by weight of carbon. These high temperatures are needed in order to reduce the stability of the high carbon content chromium carbides and in order thus to enable oxidation of the carbon. The increased smelting temperatures are reached by raising the liquidus temperature of the slag. This is effected almost exclusively by control of the $MgO/Al_2O_3$ ratio, an increase in the MgO content raising the melting point of the slag. This $MgO/Al_2O_3$ ratio, as well as the $SiO_2$ content of the slag necessary for the appropriate viscosity of the slag, may be adjusted by appropriate mixture of ores.

Lumpy, and as far as possible coarsely crystalline, ores occur only to a very limited extent. By far the greater part of ore deposits consist very largely of fine ores, or coarse ores which are very easily friable.

These fine ores and the friable coarse ores are not suitable in the processes operated hitherto for smelting ferrochrom with a carbon content of 4 to 6.5% by weight. Because of their large surface area in comparison with their volume and their porosity they are relatively easily reducible. Reduction is completed largely still inside the solid mixture of ores. In the actual smelting chamber there are then present stable high carbon content carbides, and also free chromium oxide is lacking in the slag for partially oxidizing the carbides.

In the case of fine ores, there are further added the difficulties which in general exist as regards their smelting in the electric reduction furnace, because they prevent satisfactory flow of gas through the mixture of ores, and thereby can cause considerable disturbance in operation of the furnace. Hitherto, their use has been restricted only to very small furnace units which, however, as a rule work uneconomically. Strenuous efforts have therefore been made to agglomerate the fine ore, and then to smelt it in large economically competitive furnace units. The methods to be found in use at present in heavy industry for agglomerating fine chromium ore are pelletizing, briquetting and sintering.

In all these possibilities, a reducing agent can be incorporated in order to obtain a wholly or partially self-fluxing lumpy charging material for the electric reduction furnace. These intermediate products may likewise be introduced hot into the electric reduction furnace. If an intermediate product, pellet, briquette or sintered charge already mixed with carbon is preheated within a certan temperature range pre-reduction of the chrome ore commences. This is as a rule deliberately aimed at.

The three intermediate products, whether as a cold or hot charge, have a high reactivity with carbon in comparison with lumpy ore. That means for the smelting process in the electric reduction furnace that the fine ore agglomerated in this way also again begins to react in the upper zones of the furnace so that, for the reasons previously mentioned, the smelting of FeCr with only 4 to 6.5% by weight of carbon is in practice not possible.

If a predetermined material is used, high carbon content chromium carbides $(CrFe)_7C_3$ reach the electric reduction furnace which further strengthen the effect of stabilization of the chromium carbides.

The advantage of agglomerating the fine chrome ore consists in the fact that the fine ore can be smelted industrially. But it must not be overlooked that the agglomeration of the fine chrome ore causes considerable expense and also only allows the smelting of ferrochrome alloys containing 6.5 to 8% by weight of carbon.

According to the present invention, there is provided a method of continuous smelting of ferrochrome with less than 6.5% by weight carbon content in a electric reducion furnace, in which, separately from the normal mixture of ores continuously fed into the melt and consisting of lumpy ore or agglomerated fine ore, part of the mixture of ores is introduced as wholly or partially unreduced oxide-rich chrome ore directly into the bath of slag.

The method in accordance with the invention may be put into practice as follows.

The furnace is charged with a mixture of ores which through the easy reducibility of the chrome ore used would normally allow only the smelting of high carbon ferrochrome (5.5 to 8% C). But, at the same time, part of the mixture of ores, chiefly fine or classified lumpy chrome ore, is fed directly into the bath of slag. In that way, the oxygen potential in the slag bath is raised by free chromium oxide.

The introduction of the fine and/or classified lumpy chrome ore is advantageously effected through hollow electrodes. By this means the charge arrives rapidly in the hot temperature zones and is brought directly to reaction temperature. Also, the chromium oxide at reaction temperature is rapidly conveyed to the corresponding co-reactants by the strong thermal current under the electrode. The co-reactants are the high carbon content chromium carbides which have been formed in the "normal burden", i.e. in the burden delivered onto the surface of the slag-covered bath of melt, and into the region surrounding the electrodes during sinking.

Adjustment of the mixture fed through the hollow electrodes directly into the slag bath is governed by the carbon content of the high carbon content chromium oxides which are formed in the "normal burden", as well as the desired final carbon content in the ferrochrome. When a corresponding excess of chromium oxides is in the burden fed directly into the bath, it is still possible to achieve, in the metal melt collecting under the layer of slag, a partial oxidation of the carbon. This may be necessary in the case of the appearance of already very stable chromium carbides such as are present, e.g., in the case of charging the electric reduction furnace with prereduced material, but also otherwise if the "normal burden" has a particularly good reducibility A considerable advantage of the method, in accordance with the invention, consists in the fact that fine ore may be used directly in the furnace. If the metallurgy allows it, one will employ the naturally occurring fine proportion of the chrome ore. But also, it will be necessary frequently to agglomerate fine ore, but is then a matter of smaller amounts then hitherto. Even if a partial decarburization of the ferrochrome is not desired, fine constituents may be fed through the hollow electrode. A mixture which has no directed decarburizing action is then selected. For this purpose are suitable fine consituents which arise when briquetting (10 to 30% by weight), or which are screened from the revolving cylindrical furnace or in the shaft furnace which may be used as a preheating or prereduction plant, which again brings about an improvement in the working of the furnace, and hence of the specific consumption values.

I claim:

1. A method for the continuous smelting of ferrochrome to obtain a product having a carbon content of less than 6.5 percent by weight, comprising the steps of (a) establishing and continuously maintaining an electric reduction furnace at smelting temperature;

(b) continuously introducing into the top of said furnace a burden for the production of ferrochrome comprised of fine chrome ore and coke;

(c) continuously reducing in a first reducing step said burden into a ferrochrome product having a carbon content higher than 6.5 percent;

(d) simultaneously with said introducing and said reducing steps, continuously supplying to said furnace directly into the molten slag layer thereof additonal quantities of lumpy or agglomerated fine chrome ore and coke, said additional quantities separate from those of said introducing step;

(e) simultaneously with said introducing and supplying steps, continuously maintaining the temperature of the melt in said furnace at a level which insures heat transfer between the oxide-rich chrome ore and the reactants in said furnace at the same degree as the which occurs when smelting ferrochrome having a carbon content by weight of between the range of about 6.5 and 8 percent;

(f) simultaneously with said first reducing step, rapidly reducing in a second reducing step continuously said ores from said supplying step in said molten slag layer;

(g) continuously combining in said furnace said ferrochrome obtained from said first and second reducing steps to obtain a combined ferrochrome product with a carbon content of less than 6.5 percent by weight; and (h) continuously withdrawing said ferrochrome product from said furnace.

2. The method of claim 1, further characterized by (a) said supplying step being carried out by introducing said quantities through a hollow electrode.

3. The method of claim 1 further characterized by (a) said temperature maintaining step being at a level which insures the heat transfer of the oxide-rich chrome ore to the reactants in said furnace at a higher degree than that which occurs when smelting ferrochrome having a carbon content by weight of 6.5–8 percent.

* * * * *